United States Patent [19]

Fischer

[11] Patent Number: 4,825,762

[45] Date of Patent: May 2, 1989

[54] SHEET TRANSPORT ARRANGEMENT FOR PRINTING MACHINES

[75] Inventor: Hermann Fischer, Augsburg, Fed. Rep. of Germany

[73] Assignee: MAN Roland Druckmaschinen AG, Offenbach am Main, Fed. Rep. of Germany

[21] Appl. No.: 227,368

[22] Filed: Aug. 2, 1988

[30] Foreign Application Priority Data

Aug. 12, 1987 [DE] Fed. Rep. of Germany ..... 3726780

[51] Int. Cl.[4] ..... B41F 9/00

[52] U.S. Cl. ..... 101/142; 101/232; 271/270; 271/236; 271/245

[58] Field of Search ..... 101/142, 144, 145, 232, 101/233, 234, 235, 236, 237, 238, 183, 184, 137, 246, 247; 271/270, 236, 245, 226, 246, 247

[56] References Cited

U.S. PATENT DOCUMENTS

| | | | |
|---|---|---|---|
| 2,335,954 | 12/1943 | Neal | 101/145 |
| 2,708,405 | 5/1955 | Gegenheimer | 101/234 |
| 3,593,662 | 7/1971 | Gates | 101/144 |
| 3,764,128 | 10/1973 | Bolza-Schuneman | 101/232 |
| 3,858,508 | 1/1975 | Kaneko et al. | 101/142 |
| 3,954,494 | 5/1976 | Suzuki | 101/232 |
| 3,960,079 | 6/1976 | Cape III | 101/232 |
| 4,423,677 | 1/1984 | Fisher | 101/232 |

*Primary Examiner*—Eugene M. Eickholt

*Attorney, Agent, or Firm*—Frishauf, Holtz, Goodman & Woodward

[57] ABSTRACT

To increase the operating speed of a printing machine in which sheets are fed from a make-ready table (5) to a printing system (P, G; 2, 3, 65, 63), sheets are fed to the make-ready table in a transport direction and a lateral force is applied to the sheets as they are being fed to the make-ready table, for example by inclined belts (6–9). A feed roller, operating at a rotationally non-uniform speed, accelerates sheets gripped between the feed roller (18) and a counter roller (32) and the accelerated sheets then impinge on front register stops (50; 59) on either a transfer cylinder (34) or the impression cylinder (60) itself, the transfer cylinder or the impression cylinder, respectively, being driven at rotational non-uniform speed, first slightly slower than the accelerated speed of the sheets to ensure gentle impingement on the front register stops of the transfer cylinder or the impression cylinder, and then, after being gripped, the respective cylinder accelerates to a speed which , for the transfer cylinder, will be the same as an associated impression cylinder or, for the impression cylinder itself, to the same speed as the cylinders of the printing system.

14 Claims, 7 Drawing Sheets

SHEET TRANSPORT ARRANGEMENT FOR PRINTING MACHINES

The present invention relates to printing machines, and more particularly to sheet-fed printing machines and apparatus to transfer sheets from a make-ready table for printing between an impression cylinder and another cylinder which carries the subject matter to be printed which may be a raised letter cylinder, an intaglio cylinder, or a rubber blanket cylinder of an offset plate cylinder - blanket cylinder couple.

THE INVENTION

It is an object to provide a printing machine and a sheet feeding apparatus or sheet transfer mechanism for the printing machine which is simple, has a minimum of movable sheet transfer elements and is capable of supplying to the printing system a large number of sheets per unit time, with the sheets being located in perfect register with respect to reference markers. The mechanism should be so simple that high-speed operation of the printing machine and the printing system is possible.

Briefly, a transport arrangement is provided on the make-ready table which engages the sheet and applies a moving force thereon which is transverse to the feeding direction of the sheet to the printing system. The make-ready table carries, as well known, side and front reference stops, the transport arrangement feeding the sheet against the stops, so that they will be placed in perfect register with respect thereto. The sheet is fed to the printing system by a feed roller which engages one side of the sheet and a counter roller arrangement, which may be a single roller or a plurality of counter rollers which intermittently engage against the sheet to press the sheet against the feed roller and, then, lift off the sheet. A drive arrangement drives the feed roller rotationally or circumferentially non-uniformly. The reference to rotational non-uniform drive is intended to convey that, for some period of time during rotation of an element, the element accelerates and then decelerates. A given speed may be maintained between the acceleration and deceleration modes. The feed roller is driven such that when the counter roller engages a sheet against the feed roller, it is operating in the accelerating mode to accelerate the sheet being supplied from the make-ready table for further feeding to the printing system.

The feed roller may supply the sheet directly to the printing system or, if desired, to the printing system via a transfer drum. If a transfer drum is used, the transfer drum has a front register stop and a gripper system gripping a sheet transferred thereto by the feed roller to guide the sheet against the front register stop. The transfer drum is arranged to transfer the sheet from the make-ready table as it is being fed by the feed roller to the printing system, for example an impression cylinder which has grippers thereon and which is in printing engagement with a suitable cylinder carrying the printed subject matter. The transfer drum is driven rotationally non-uniformly by a non-uniform drive mechanism. The drive mechanism so drives the transfer drum that the circumferential speed thereof is below the linear speed of a sheet being supplied to the transfer drum from the make-ready table, the transfer drum then accelerating the sheet after it has been gripped, to reach the speed which corresponds to the circumferential speed of the impression cylinder for transfer of the sheet thereto.

Alternatively, the sheet can be directly transferred to the impression cylinder. The impression cylinder then is formed with front register stops and grippers which align the sheet with the front register stops. The impression cylinder is then driven rotationally non-uniformly, in an accelerating mode upon receipt of the sheet from the make-ready table. When the cylinder carrying the printed subject matter has reached the printed subject matter to be transferred to the sheet, the impression cylinder is then rotated at the same speed as that of the printed subject matter cylinder.

Drawings, illustrating embodiments of the invention:

DETAILED DESCRIPTION

The invention will be described in connection with a rotary offset printing machine although, it is to be understood, it may be used with other types of rotary sheet-fed printing machines as well.

Figure 1:
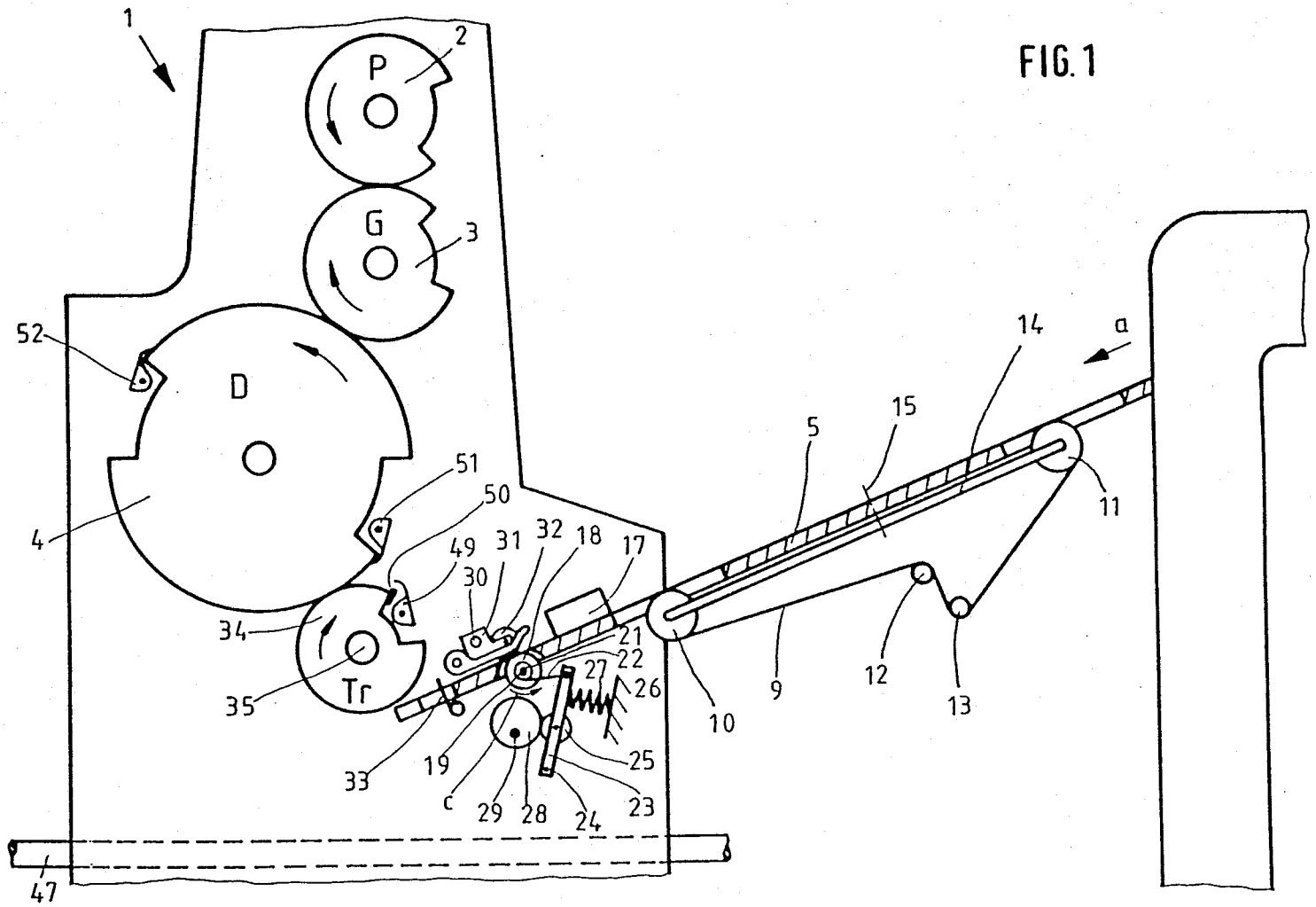
FIG. 1 is a highly schematic side view of the printing arrangement of the printing machine showing the make-ready table, partly in section, and the printing system in schematic arrangement.

FIG. 1 illustrates a printing machine having a printing station generally shown at 1, including a plate cylinder 2 and a rubber blanket cylinder 3, for printing on a sheet against an impression cylinder 4. The impression cylinder 4 has twice the diameter of the cylinders 2, 3 and has two gripper systems 51, 52 at the circumferential region thereof. Other types of printing systems may also be used, for example raised letter systems and intaglio systems.

Figure 2:
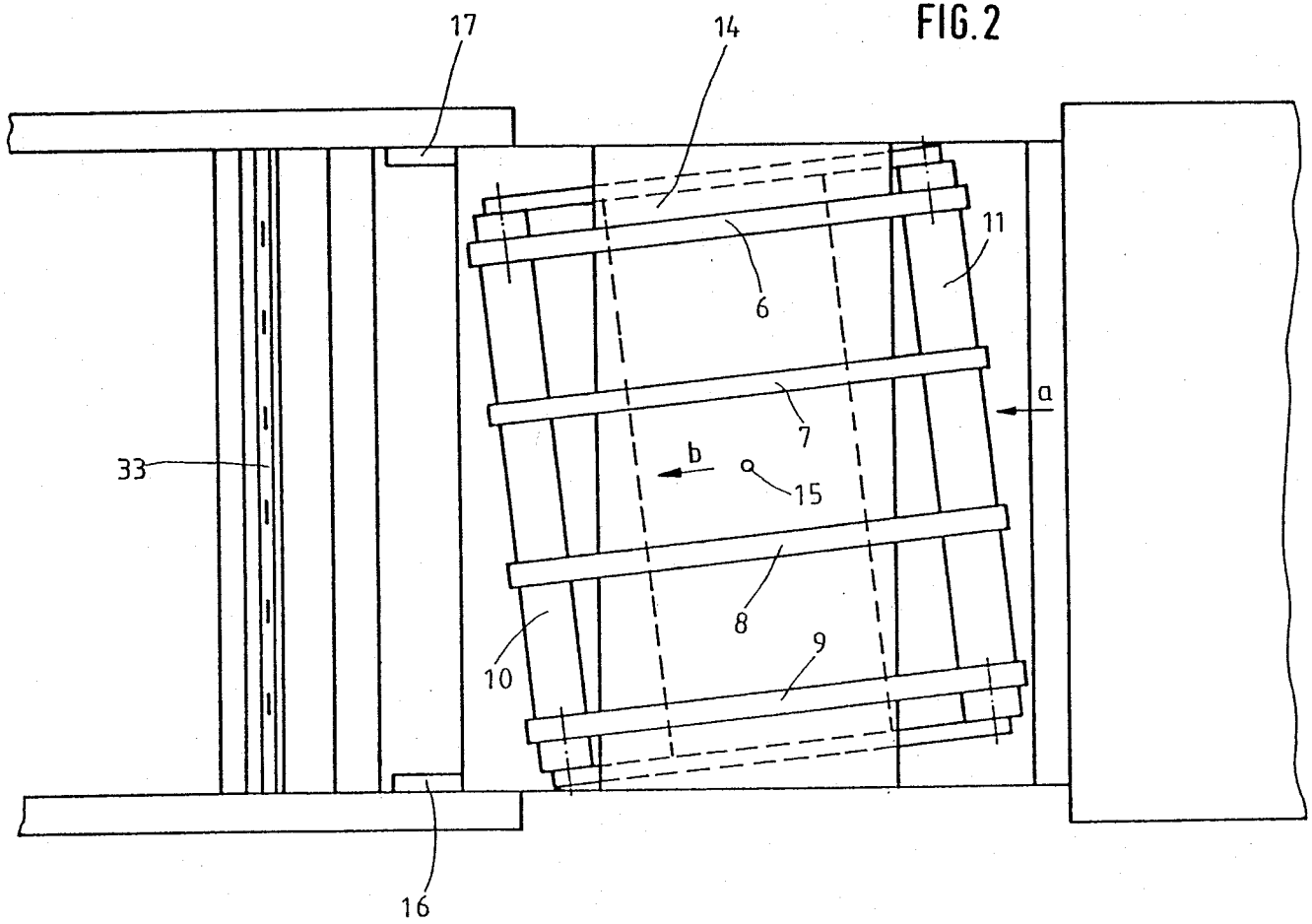
FIG. 2 is a top view of the make-ready table.

A make-ready table 5 receives sheets in single feed, as well known, and not further described. The sheets are fed in the direction of the arrow a. A plurality of transport belts 6, 7, 8, 9 are located within the make-ready table, running over, respectively, two turn-around rollers 10, 11 and being stretched by a plurality of stretching or tensioning rollers 12, 13—see FIGS. 1 and 2. At least one of the turn-around rollers 10 or 11 is driven, in such a manner that the upper run of the transport belts will operate in the direction of the arrow b (FIG. 2). The transport belts 6–9 thus run at an inclined angle with respect to the supply direction of the sheets, see arrow a. Preferably, the turn-around rollers 10, 11 as well as the tensioning rollers 12, 13 are secured to a carrier frame 14 which is rotatable about an axis 15 in order to be able to adjust the acute angle between the arrow a, that is, the transport direction of the sheets as received, and the arrow b, that is, the transport direction of the transport belts 6–9. Two lateral register guide markers 16, 17 are secured to the make-ready table at respective sides, located close to the end of the make-ready table which faces the printing machine 1. In the arrangement according to FIG. 2, transport belts 6–9 feed the respective sheets with a component of movement transverse to the supply direction as shown by the arrow a, to feed the sheet against the lateral marker 16, and thereby provide for lateral register of the sheets already during transport thereof. Locating the respective belts on the rotatable frame 14 permits guidance of the sheets also against the lateral register marker 17 for lateral register thereagainst. The arrangement, thus, permits placing the make-ready table 5 at desired locations with respect to a sheet supply or sheet feeding structure, as well known.

It is also possible to obtain a transverse component of movement for the sheet by providing transport belts which run in the direction of feed of the sheet and, additionally, provide for compressed air jets directing the sheet transversely against the respective register markers 16, 17; further, the arrangement as shown in FIGS. 1 and 2 may be used independently of compressed air, together with compressed air blasts, or an additional transport belt running transversely to the direction of the arrow a.

A feed roller 18 is located downstream - in the direction of sheet feeding, see arrow a, of the register markers 16, 17. The feed roller 18 extends over the entire width of the make-ready table 5; alternatively, it may be a shaft element with individual roller sections thereon. A spiral spring is wrapped about the shaft 19 of the feed roller, one end of which is connected to a fixed element of the make-ready table, and the other to the feed roller 18. The spiral spring is so arranged that it has the tendency to rotate the feed roller 18 counter the direction of the arrow c (FIG. 1). The two ends of the feed roller 18 are connected to respective sheaves 21, which have a rope or cord 22 connected thereto, and which is wrapped around the respective sheaves. The other end of the cord or rope 22 is connected to a lever 23 which is pivotable about a shaft 24. Each lever 23 carries a roller 25 which is held in engagement with a cam roller 28, in form of an eccenter. The lever 23 is biassed against the cam roller 28 by a compression spring 27 which engages the lever 23 at one end and is supported on a fixed part of the frame of the machine at the other.

The cams 28, one on either side of the machine and only one of which is visible in FIG. 1, are securely connected to a shaft 29, which operates in synchronism with the rotation of the printing machine. Rather than a drive for the roller 18 of this type, other drives which, alternately, accelerate the roller by deflecting the lever 23 to the right (FIG. 1) and hence pulling on the cable or rope 22, to be returned by the spiral spring, may be used.

A plurality of pivoting levers 31 are located on a cross shaft 30 positioned above the make-ready table 5. Each one of the pivot elements or levers 31 has a counter roller 32 journalled thereon. The cross shaft 30 is so controlled in synchronism with rotation of the printing machine that the counter rollers 32 are pressed alternately against the feed roller 18 and then are removed or lifted off the feed roller.

Front register stops 33, as well known, are located at the front end of the make-ready table, downstream of the feed roller 18. The table front register stops 33 may, for example, include a plurality of stop elements positioned staggered across the width of the make-ready table 5.

A transfer drum 5 is located above the end of the make-ready table 5. The transfer drum or cylinder 34 carries a cylinder front register stop 50 and a gripper system 49. The diameter of the transfer cylinder 34 is smaller than the diameter of the plate cylinder 2, since the transfer cylinder 34 will operate at a smaller average circumferential speed than the plate cylinder 2 due to the delay occasioned by the supply speed of the sheets. After each half revolution of the impression cylinder 4, which operates at the same circumferential speed as the printing cylinder, the gripper system 49 of the transfer cylinder 34 must be opposite one of the gripper systems 50 or 51 of the impression cylinder.

In accordance with an alternative embodiment, the transfer cylinder 34 may have a diameter just somewhat smaller than that of the impression cylinder and then, likewise, carry two gripper systems.

Figure 3:
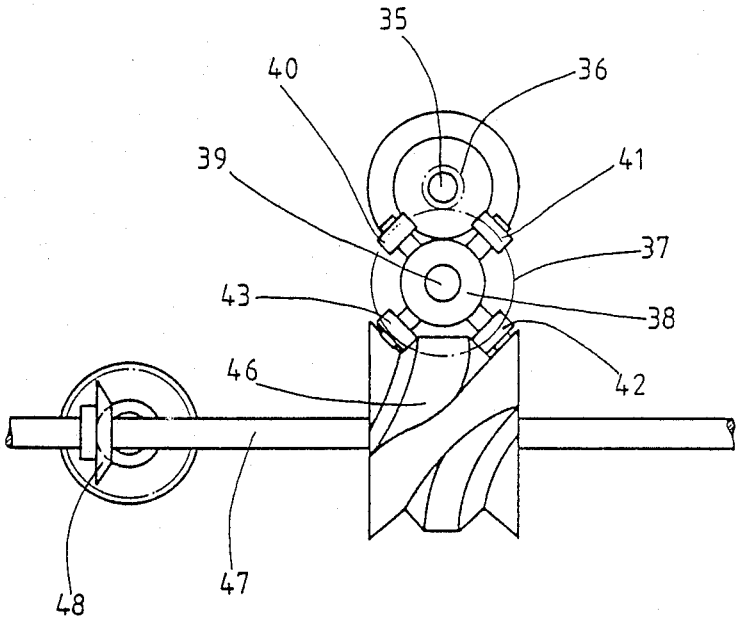
FIG. 3 is a schematic side view of a non-uniform drive arrangement, for example for a transfer cylinder.

The transfer cylinder 34 is driven by a rotationally non-uniform drive mechanism which is illustrated, schematically, in FIG. 3. The transfer cylinder 34 is secured to a shaft 35 which has a pinion 36 secured thereto. The pinion 36 is in engagement with a spur gear 37 which is secured to a shaft 39, parallel to the shaft 35 carrying the transfer cylinder 34. Additionally, a carrier disk or wheel 38 is secured to the shaft 39. The carrier wheel 38 carries four rollers 40, 41, 42, 43. The rollers 40–43 operate in pairs in engagement with lateral flanks of a raised control cam surface 46. The elements 38–46, together, form a rotationally non-uniform drive or transmission which accelerates the shaft 35 and hence the cylinder 35 continuously from a low circumferential speed to a high circumferential speed, retains the high circumferential speed for a short period of time, and then maintains, for a short period of time, a low circumferential speed before, again, accelerating the shaft 35 and repeating the cycle.

The control cam 46 is secured to the main shaft 47 of the printing machine. The main shaft 47 of the printing machine carries a bevel gear 48, one for each printing system, to drive the impression cylinder 4, blanket cylinder 3 and plate cylinder 2 as well known and in accordance with any suitable or standard arrangement.

Operation: A sheet feed in direction of the arrow a to the make-ready table 5 is engaged by the transport belts 6–9 shortly after having been placed on the make-ready table. It is there guided in the direction of the arrow b against the lateral register stop or marker 16. This ensures lateral register already during supply of the respective sheets, and no additional time is required to align the sheet laterally. An additional of time to provide for lateral register alignment during which the sheet does not move already in the direction towards the front register stop is not required. This permits shingled or imbricated arrangement of sheets with tight placement. Tight placement of sheets, that is, sheets overlapping closely above each other, permits high operating speed of the machine.

As soon as the front edge of the respective sheet engages the table front or forward register stop 33, cams 28 rotate to deflect the lever 23 by engagement with the cam rollers 25, deflection being carried out against the pressure of the compression springs 27. The ropes 33 begin to roll off from the sheaves 21 and the feed roller 18 is accelerated in the direction of the arrow c. At the same time, the cross shaft 30 pivots the levers 31 to bring the counter rollers 32 in engagement against the sheet. The cam disks 28 are eccentrically so positioned that, upon further rotation of the shaft 29, the lever 23 is deflected by an increasing extent so that the feed roller 18 is accelerated, and thereby also accelerates the sheet being fed thereby. The engagement of the sheet between the feed roller 18 and the counter rollers 32, which are pressure rollers, for example spring-loaded, ensure that, independently of the thickness or any waviness or undulation of the sheet, the front edge which was previously in register alignment with the register stop 33 is moved, in alignment to the transfer cylinder 34, without danger of canting or lateral shifting of the respective sheet.

The sheet reaches the end of the make-ready table 5 with a speed which is slightly higher than the circumferential speed of the transfer cylinder 34. This means that the sheet will engage in the open grippers of the gripper system 49 and reliably fit against the front register markers 50 on the transfer cylinder 34—see FIG. 1. Register on the transfer cylinder is therefore ensured and the grippers of the gripper system 49 can then close. The sheet, engaged against the cylinder front register stops 50, can be supplied, therefore, with a speed which is below that which corresponds to the printing speed. The sequential acceleration, first by the feed roller and then by the transfer drum, prevents ricochet or bounce of the sheet when it impinges against the front or forward register stop. This is possible although the overall machine speed is very high. Additionally, since the sheet is accelerated in its pull-off movement, it will not carry along an additional sheet, for example located thereover in shingled or imbricated position.

When the sheet has been transferred to the transfer cylinder 34, the transfer cylinder 34 is accelerated by means of the rotationally non-uniform drive until the circumferential speed of the transfer cylinder 34 is at least approximately the same as the circumferential speed of the impression cylinder 4. In accordance with a preferred feature of the invention, the drive 38–46 is so designed that the transfer cylinder 34 is still accelerated when transfer of the sheet from the cylinder 34 to the impression cylinder 4 begins. This ensures precise transfer of the sheet and change in gear flank engagement in the drive of the transfer cylinder 34, which might interfere with positive transfer, is avoided.

The grippers of the gripper system 49 of the transfer cylinder 34 then transfer the sheet to the grippers of the gripper system 51 or 52, as the case may be, of the impression cylinder 4. The impression cylinder 4 operates with uniform high speed. The larger diameter of the impression cylinder 4 has the advantage that the path which is available for transfer of the sheet from the gripper system 49 to the gripper systems 51 or 52, respectively, is longer than when the impression cylinder would have the same diameter as the plate cylinder, for example, and carry only a single gripper system. A still longer transfer path can be obtained by also enlarging the transfer drum 34 to have a diameter just somewhat less than that of the impression cylinder 4 and supplying two gripper systems to the transfer cylinder.

As soon as the sheet has been transferred to the respective gripper system 51 or 52, the rotationally nonuniform drive slows until its circumferential speed is slightly less than that of the linear speed with which the next sheet is supplied to the transfer cylinder 34 from the make-ready table 5.

Figure 4:
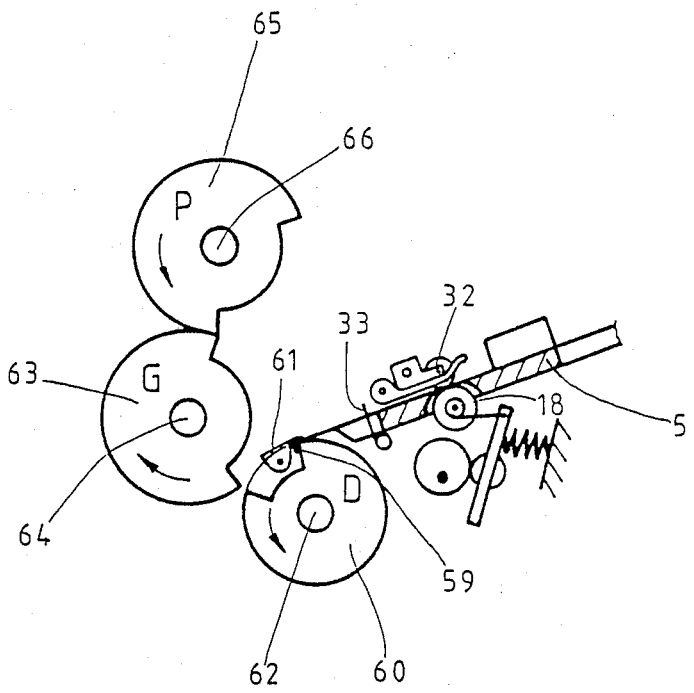
FIG. 4 is a fragmentary side view, corresponding to FIG. 1, and illustrating a modification in which transfer of a sheet is directly to an impression cylinder, and illustrating only those elements necessary for an understanding of the invention which differ from the structure of FIG. 1.
Figure 5:
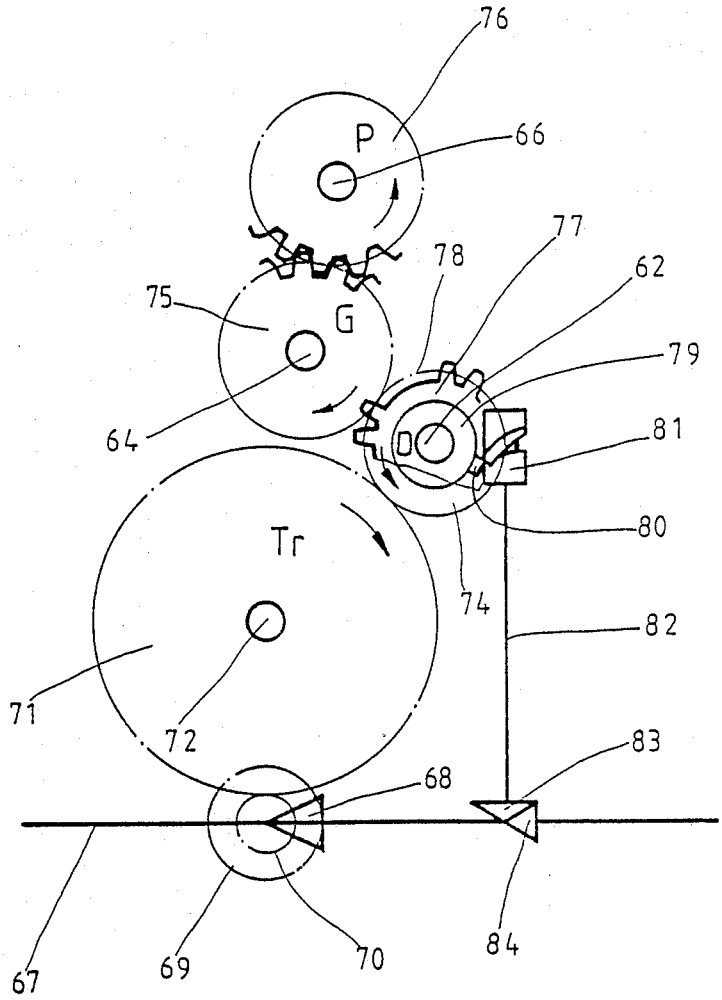
FIG. 5 is a schematic side view of the drive for the system of FIG. 4.
Figure 6:
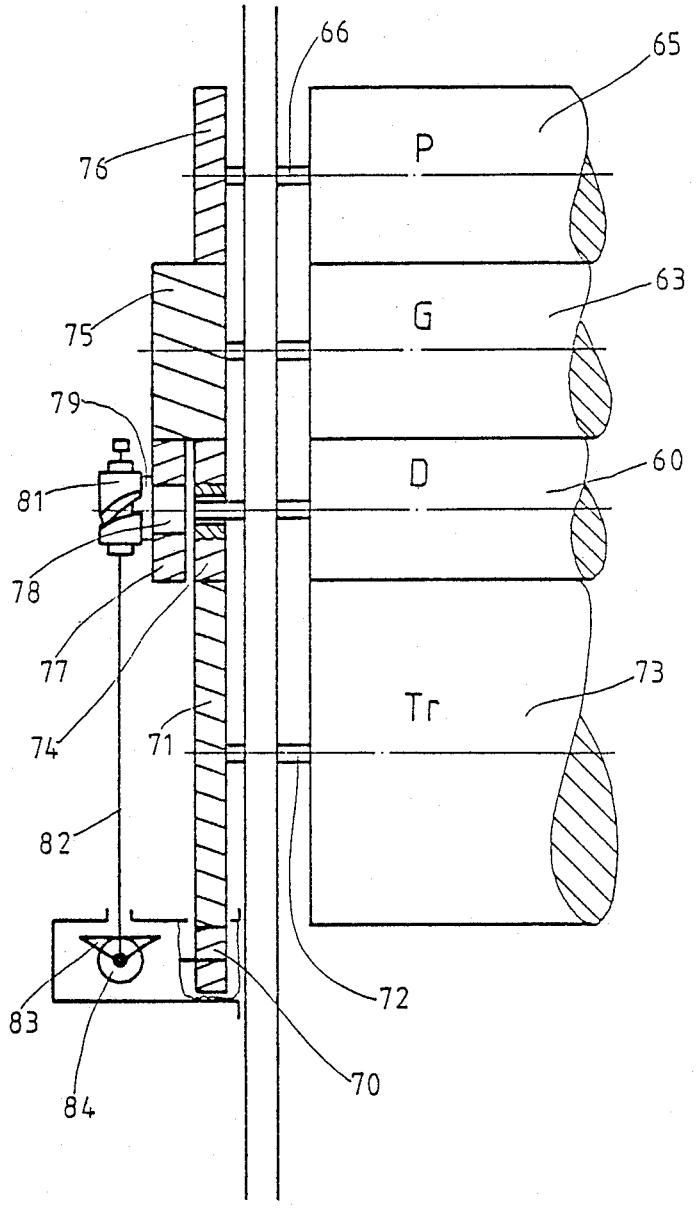
FIG. 6 is a front view of the drive of FIG. 5 in which the axis of the cylinders and drum are placed in a single plane, for better visualization of the drive arrangement.

In accordance with a feature of the invention, and as shown in FIGS. 4–6, the transfer cylinder 34 can be eliminated if the impression cylinder itself is driven by a rotationally non-uniform drive for a portion of its revolution, and in synchronism with the plate cylinder, to be then decelerated to reach a speed just slightly under the linear speed of a sheet to be supplied from the make-ready table.

FIGS. 4 to 6 illustrate the arrangement in which the same make-ready table 5, feed roller 18, counter rollers 32 and table front register stops 33 are used, as in the embodiment of FIGS. 1–3. The spiral spring returns the feed roller 18 to the rest position upon rotation of the cam 28, when the compression spring 27 pushes the lever 23 to the left (FIG. 1).

FIG. 4 illustrates the arrangement in which impression cylinder 60 is located immediately downstream of the make-ready table 5. The impression cylinder 60 has a cylinder front register stop 59 and a gripper system 61 in order to retain a sheet against the front register stop 59. The impression cylinder 60 is seated on a shaft 62 and is in printing engagement with the blanket cylinder G, 23, secured to a shaft 64. The blanket cylinder 63 is in printing engagement with a plate cylinder P, 65, secured to a shaft 66.

The rotational non-uniform drive of the cylinder 60, as well as the drive of the blanket cylinder 63 and plate cylinder 65, is obtained from the main drive shaft 67 of the printing machine. The drive shaft 67 carries a bevel gear 68 which is in engagement with a further bevel gear 69. A pinion 70 is coupled to the bevel gear 69 which is in meshing engagement with a gear 71. Gear 71 (FIG. 5) is seated on a shaft 72 which has transport drum 73 secured thereto. The transport drum 73 is not visible in FIG. 5, being hidden behind the gear 71. The transport drum 73 is formed with grippers, in the usual manner, and is used to remove sheets from the impression cylinder 60 for further transport of the sheets, for example to a transport belt system, a stacking table or the like (not shown).

Gear 71 on shaft 72 is in meshing engagement with the gear 74 (FIGS. 5, 6) which is loosely rotatable on a shaft 62 of the impression cylinder 60. Gear 74 is in engagement with a gear 75 which is secured to the shaft 64 of the rubber blanket cylinder 63. Gear 75 is wider than the gear 74.

Gear 75 is in further engagement with a gear 77 which is secured to the shaft 62 of the impression cylinder 60. The gear 77 has teeth which extend only over a portion of their circumference, as seen, schematically, in FIG. 5, leaving blank a region 78 without teeth.

The shaft 62 of the impression cylinder 60 additionally carries a carrier disk 79 which, in turn, carries a cam roller 80 at an end thereof which is in engagement with a spatial cam curve 81. Cam curve 81 is connected via a shaft 82 to the main drive shaft 67, for example through a bevel gear 83 which is in meshing engagement with a further bevel gear 84 secured to the main drive shaft 67.

The cam curve 81 of the drive 79–81 is so arranged that the cam follower roller 80 is carried along by interengagement with the cam curve 81 when the blank region 78 of the gear 77, that is, the toothless region 78 runs off on the gear 75. The shape of the cam curve 81 is so selected that in this region, the disk 79 is first decelerated or delayed and then accelerated until the disk 79, and hence the gear 77, will have the same circumferential speed as the gear 75, which is continuously driven from the main drive shaft via pinion 70, gear 71, and gear 74.

The deceleration is so arranged that the impression cylinder D, 60 is decelerated to a value in which the linear speed of the impression cylinder at the circumference is just slightly less than the supply speed of a sheet being fed by the feed roller 18 from the make-ready table 5.

OPERATION, EMBODIMENT OF FIGS. 4–6

A sheet supplied by the feed roller 18 from the make-ready table 5 to the impression cylinder 60 is supplied at a speed which is just slightly higher than the circumferential speed of the impression cylinder 60. When the sheet reaches the cylinder front register marks 59 of the impression cylinder 60, the grippers of the grippers 61 thereon will close. Immediately thereafter, the control curve 81 secured to the shaft 82 and in driving engagement with the main drive of the machine accelerates the shaft 62 of the impression cylinder 60. When the impression cylinder 60 has reached the circumferential speed of the blanket cylinder 63, the gearing of the gear 77 will engage in the gear 75. The impression cylinder 60 is then driven by the gear teeth of the gear 75. In this region, the cam follower 80 is out of engagement with the cam 81, so that the drive through the gear 75 is not interfered with. Printed subject matter is then transferred to the sheet gripped on the impression cylinder 60. The sheet, after printing, is then transferred to the transport drum 73 for removal, as well known.

As soon as the printing has terminated, the toothless region 78 of the gear 77 again faces the gear 75, so that the gear 75 no longer drives the shaft 62 of the impression cylinder. At this moment, the cam follower roller 80 again engages the cam curve or surface 81, in which it is guided essentially without play, and the impression cylinder is driven via the cam curve 81. The effective range of the cam curve is so selected that the impression cylinder 60 is decelerated so that its circumferential speed will again be just slightly less than the linear speed of the next subsequent sheet to be received from the make-ready table 5. The plate cylinder 65 and the blanket cylinder 63 continue to be driven at their normal speed during deceleration and acceleration of the impression cylinder via the gears 71, 74, 75, 76.

With respect to one revolution, the average circumferential speed of the impression cylinder 60 is less than the circumferential speed of the blanket cylinder 63 or of the plate cylinder 65, respectively. These speeds are the same since, usually, the cylinders are of the same size. Consequently, the diameter of the impression cylinder, however, must be somewhat smaller than that of the blanket or rubber cylinders, respectively.

Various changes and modifications may be made, and any of the features described herein may be used with any of the others, within the scope of the inventive concept. The rotationally non-uniform drives which are illustrated are suitable although, of course, other rotationally non-uniform drives may be used.

Figure 3A:
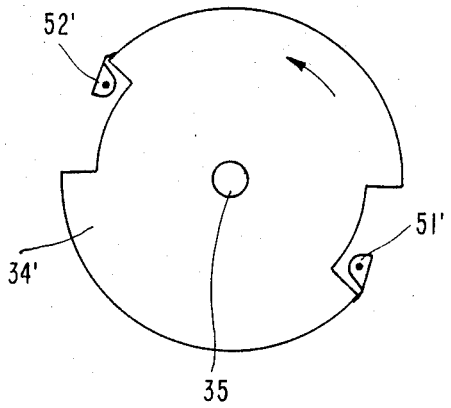
FIG. 3A shows a schematic transfer cylinder with grippers.

FIG. 3*a* illustrates in schematic form a transfer cylinder **34*a* with grippers 51' and 52' thereon, for example similar to the grippers 51, 52 on the impression cylinder (D, 4) of FIG. 1, but receiving sheets from the make-ready table and transferring the sheets to the respective grippers 51, 52 of the impression cylinder 4 (FIG. 1**).

I claim:

1. Sheet-fed printing machine having a printing system (1) including an impression cylinder (D, 4) having sheet grippers (51, 52) thereon, printing subject matter cylinder means (P, G; 2, 3) for applying printed subject matter on a sheet between the impression cylinder (4) and the printed sheet cylinder means, a make-ready table (5), and means for transferring a sheet from the make-ready table (5) to the printing system, said sheet transfer means comprising, in accordance with the invention, the combination of (FIGS. 1–3)

transport means (6–9) on the make-ready table (5) engaging a sheet thereon and applying a moving force on the sheet in a feeding direction (a) and additionally transversely to the feeding direction (a) of the sheet towards the printing system (1) and arranging the sheet on the make-ready table against table front register stops (33) and against side register stops (16, 17);

with feed roller means including a feed roller (18) engaging one side of the sheet, a counter roller (32) intermittently engaging against and disengaging from the feed roller (18) with a sheet interposed therebetween, and drive means (21–29) coupled to at least one of said rollers and alternately driving the at least one roller in an accelerating mode and a decelerating mode, said at least one roller frictionally engaging a sheet during drive in the accelerating mode and accelerating the sheet in the feed direction;

with a transfer cylinder or drum (34) having a cylinder front register stop (50), a gripper system (49) gripping a sheet transferred to said transfer cylinder (34) by said feed roller means and the feed roller (18) guiding the sheet against the front register stop (50) and arranged for transfer of the sheet from the make-ready table to be fed by said transfer drum to the impression cylinder (D, 4);

and with a rotational non-uniform drive means (38–46) driving the transfer cylinder or drum (34), said rotational non-uniform drive means driving the transfer cylinder or drum at a circumferential speed which is below that of the linear speed of the sheet being supplied to the transfer cylinder or drum upon transfer of the sheet thereto from the make-ready table, said rotationally non-uniform drive means then driving and accelerating the transfer cylinder or drum to reach a speed which corresponds to the circumferential speed of the impression cylinder upon transfer of the sheet to the impression cylinder.

2. The machine of claim 1, wherein the transport means (6–9) comprises transport belt means arranged at an angle of inclination with respect to the feeding direction (a) of the sheet being supplied to the make-ready table.

3. The machine of claim 1, wherein the impression cylinder (4) has two sheet gripper systems thereon, circumferentially offset from each other.

4. The machine of claim 1, wherein the transfer cylinder or drum (34') comprises two gripper systems (51', 52').

5. The machine of claim 1, wherein the rotational non-uniform drive means (38–46) comprises a threedimensional cam or curve drive.

6. The machine of claim 1, wherein the rotational non-uniform drive means (38–46) drives said transfer cylinder or drum for transfer of a sheet to the impression cylinder (4) substantially at the termination of acceleration of the drum as it is being driven.

7. The machine of claim 1, wherein the drive means (21–29) for the feed roller means are coupled to said feed roller (18) and drive said feed roller in oscillatory, reversing manner, each oscillation cycle including a drive phase in feeding direction during which said accelerating mode occurs, and then, after the sheet has been gripped by the transfer cylinder or drum, in a decelerating mode; and in a return phase to return the drive roller to an initial position for another oscillatory cycle starting with the feed phase in the accelerating mode.

8. Sheet-fed printing machine having a printing system (1) including an impression cylinder (D, 60) having sheet grippers (61) thereon, printing subject matter cylinder means (P, G; 65, 63) and means (66, 64) for driving the printed subject cylinder means for applying printed subject matter on a sheet between the impression cylinder (60) and the printed subject cylinder means;

a make-ready table (5), and means for transferring a sheet from the make-ready table (5) to the printing system, said sheet transfer means comprising, in accordance with the invention, the combination of (FIGS. 1–3)

transport means (6–9) on the make-ready table (5) engaging a sheet thereon and applying a moving force on the sheet in a feeding direction (a) and additionally transversely to the feeding direction (a) of the sheet towards the printing system (1) and arranging the sheet on the make-ready table against table front register stops (33) and against side register stops (16, 17);

with feed roller means including a feed roller (18) engaging one side of the sheet;

a counter roller (32) intermittently engaging against and disengaging from the feed roller (18) with a sheet interposed therebetween, and drive means (21–29) coupled to at least one of said rollers and alternately driving the at least one roller in an accelerating mode and a decelerating mode, said at least one roller frictionally engaging a sheet during drive in the accelerating mode and accelerating the sheet in the feed direction;

with a cylinder front register stop (59) located on the impression cylinder (60) to define a front register position of a sheet gripped by the grippers (61) of the impression cylinder, said impression cylinder being located downstream, in sheet feeding direction (a) from the make-ready table (5) to receive and grip sheets fed from the make-ready table (5) by the feed roller means (18, 32);

and with rotational non-uniform drive means (79–81) driving the impression cylinder (60), said rotational non-uniform drive means driving the impression cylinder at a circumferential speed which is below the linear speed of the sheet being supplied thereto by the feed roller means from the make-ready table, upon transfer of a sheet to the impression cylinder, said rotational non-uniform drive means then driving and accelerating the impression cylinder and, during transfer of printed subject matter to the sheet on the impression cylinder from the printed subject matter cylinder means (P, G; 65, 63), driving said impression cylinder at the same linear speed as the printed subject matter cylinder means being driven by the printed subject matter cylinder drive means (66, 64).

9. The machine of claim 8, wherein the transport means (6–9) comprises transport belt means arranged at an angle of inclination with respect to the feeding direction (a) of the sheet being supplied to the make-ready table.

10. The machine of claim 8, wherein the impression cylinder (4) has two sheet gripper systems thereon, circumferentially offset from each other.

11. The machine of claim 8, wherein the rotational non-uniform drive means (79–81) comprises a threedimensional cam or curve drive.

12. The machine of claim 8, wherein the drive means (21–29) for the feed roller means are coupled to said feed roller (18) and drive said feed roller in oscillatory, reversing manner, each oscillation cycle including a drive phase in feeding direction during which said accelerating mode occurs, and then, after the sheet has been gripped by the transfer cylinder or drum, in a decelerating mode; and in a return phase to return the drive roller to an initial position for another oscillatory cycle starting with the feed phase in the accelerating mode.

13. The machine of claim 8, wherein the rotational non-uniform drive means (79–81) drive said impression cylinder (60) during an acceleration phase during transfer of a sheet from the make-ready table (5) and during a deceleration phase occurring in advance of the acceleration phase;

and including means (78, 81) for driving said impression cylinder from the drive means (66, 64) for driving the printed subject matter cylinder means (P, G; 65, 63) including direct drive gearing means (68–71, 74–77) coupled to the printed subject matter cylinder means (P, G: 65, 63).

14. The machine of claim 13, wherein the means intermittently driving the impression cylinder (60) in synchronism with the drive means (66, 64) for the printed subject matter cylinder means (P, G; 65, 63) includes a gear (77) having a circumferential drive zone of gear teeth and a circumferential blank (78) free from gear teeth, said drive zone of the gear (77) being in meshing engagement with said drive means (66, 64), and the rotational non-uniform drive means includes a camming surface (81) drivingly coupled (82, 83, 84) to said drive means (66, 64) and rotationally non-uniformly driving the impression cylinder (60) during said acceleration and deceleration phases in the interval when said drive gear (77) is rotating through the blank zone (78) which does not carry gear teeth.

* * * * *